United States Patent [19]

Felder

[11] Patent Number: 4,752,035

[45] Date of Patent: Jun. 21, 1988

[54] DISPOSAL GUARD

[76] Inventor: James R. Felder, 232 "A" Otay Valley Rd., Chula Vista, Calif. 92011

[21] Appl. No.: 30,450

[22] Filed: Mar. 27, 1987

Related U.S. Application Data

[63] Continuation-in-part of Ser. No. 905,468, Oct. 28, 1986, abandoned.

[51] Int. Cl.[4] ..... B02C 18/42

[52] U.S. Cl. ..... 241/46 B; 4/287; 4/DIG. 4; 241/100.5

[58] Field of Search ..... 4/DIG. 4, 287, 292, 4/295; 241/100.5, 46 A, 37.5, 46 B, 32.5, 46.02, 257 G

[56] References Cited

U.S. PATENT DOCUMENTS 2,670,143 2/1954 Jordan ..... 4/287 X 4,337,901 7/1982 Ogura ..... 241/100.5 X

FOREIGN PATENT DOCUMENTS 176029 7/1961 Sweden ..... 4/287

*Primary Examiner*—Mark Rosenbaum

*Attorney, Agent, or Firm*—Ralph S. Branscomb

[57] ABSTRACT

A two-piece stopper is provided for insertion into the mouth of garbage disposal units. The first piece inserts snugly into the open disposal mouth and has rather large apertures through which water can pass, when the disposal unit is not in use and the sink in which it is mounted is to be used as an ordinary sink. The apertures are large enough to pass small bits of food and waste, but small enough to keep out popsicle sticks, bottlecaps, silverware, and the like. The second piece is a plug which inserts into a cylindrical wall or bore in the first piece to cover the drain apertures of the first piece so that the sink's drain opening is entirely covered and the sink can be filled with water for washing dishes and similar purposes.

1 Claim, 1 Drawing Sheet

DISPOSAL GUARD

This application is a continuation-in-part of application Ser. No. 905,468, filed Oct. 28, 1986, now abandoned.

BACKGROUND OF THE INVENTION

Since the invention of the garbage disposal, virtually every new house and apartment unit has one. When a garbage disposal unit is in place, the sink now has three different modes of operation. Before, the sink had either a plugged mode of accumulating water to wash and rinse dishes, a second open mode in which water is drained, and now, with the disposal, the sink has a third mode in which the garbage disposal is on and waste material is ground up and washed away in the waste line from the sink.

In the prior art, the mouth of the garbage disposal is generally fitted with a rubbery insert with inwardly projecting flaps which act as a splash guard. Then, into the splash guard, there may be a metal trap-like fitting with two modes, one of which is perforated to allow water to pass through, and the second of which blocks the trap so the sink can be filled. There are also, of course, simple circular rubber flaps that can be used to block the drain.

Unfortunately, the splash guard is not always effective, and there is generally some splashing that passes through the inwardly directed flaps. Also, the insert trap may have very fine openings which will become clogged with waste from the sink and slow or stop the drainage process, and these bits and particles may also prevent the second mode of the trap, in which drainage is prevented entirely, from being affected because the part that needs to slip into place to block the drain will be jammed by food matter.

There is therefore a need for an improved disposal guard which will make available all three modes of sink operation effectively, simply, and cheaply.

SUMMARY OF THE INVENTION

The instant invention fulfills the above-stated need by means of two formed rubber or rubber-like pieces, the first of which fits snugly inside the disposal mouth and doubles as both a splash guard and a trap to prevent objects from falling down within the garbarge disposal. This piece is press-fitted inside the disposal opening, and has a pair of rubbery tabs that extend alongside the bottom of the sink, laterally outwardly from the body of the insert, so that it can be pulled free of the disposal mouth to permit complete free flow of water into the disposal and thus through the drain when the disposal is not in use, and the sink is in its free-flow mode.

A second piece is a stopper which fits into a cylindrical bore in the top portion of the first piece and blocks the apertures provided through the first piece so that the sink is stopped and can be filled with water for washing and rinsing dishes and similar purposes. The stopper has a central rib which permits easy removal of the stopper with the fingers, so that the two pieces together effectively accomplish the three functions necessary to implement the three different modes of operation of the sink.

DETAILED DESCRIPTION OF THE PREFERRED EMBODIMENT

Figure 1:
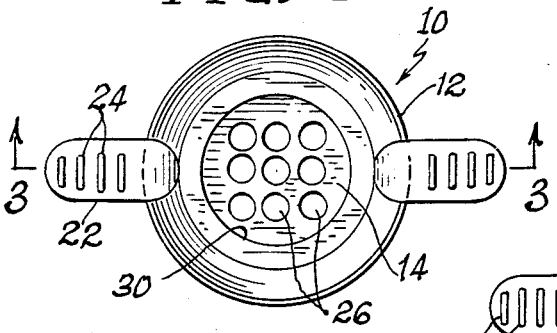
FIG. 1 is a top plan view of the first member of the disposal guard.
Figure 2:
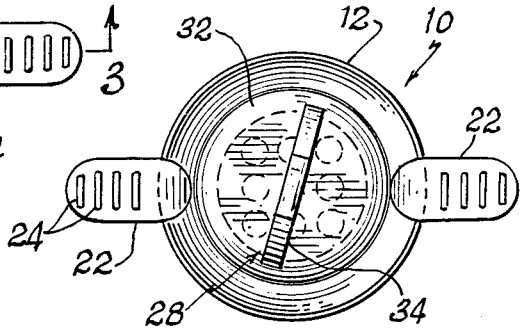
FIG. 2 is a top plan view of the first member similar to FIG. 1, with the second piece shown in place.
Figure 3:
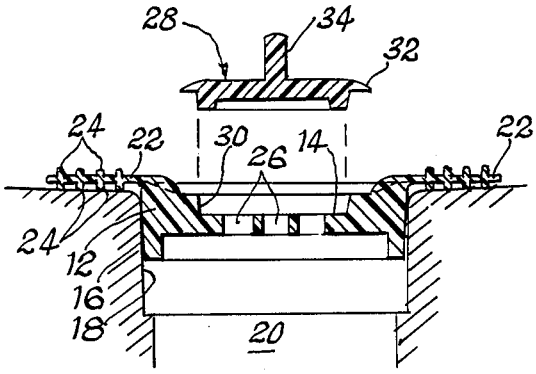
FIG. 3 is a section taken along line 3—3 of FIG. 1.

The first or main portion of the unit is indicated at 10. This portion would generally be molded, and the material from which it is made would be rubber or a rubber-like synthetic material. It has a body portion 12, and the body portion has a central apertured grid 14 and a tapered cylindrical outer wall 16 which fits into the mouth 18 of the garbage disposal, the top portion of which can be seen at 20 in FIG. 3. The cylindrical outer wall 16 is dimensioned to fit snugly within the mouth 18 of the garbage disposal opening, and the body 12 also defines the pair of laterally extended, flexible gripping tabs 22 with spaced frictional elements 24 provided along the tops and bottoms of the tabs to make them easily grippable to be pulled by the fingers to remove the main portion 10 of the disposal guard from the garbage disposal, thus freeing the sink to be used in its open, draining mode. The tabs are necessarily somewhat flexible so that they can be gripped, and the generally hard, but still rubbery and somewhat resilient and flexible qualities needed in the tabs is also present throughout the rest of the body portion 12 of the main portion 10 of the device.

The grid 14 is provided with apertures 26 which are for the purpose of permitting the sink to drain when the main portion 10 is in place. In this mode, the sink 10 and drain, and the disposal can be run and the disposal guard will act as a splash guard. The apertures are preferably on the order of one-quarter to three-eights of an inch in diameter. Apertures of this size will prevent Popsicle sticks and silverware and other objects from falling through the guard into the disposal area, but will permit small pieces of food and debris to fall through so that some of the disposal operation can be taken care of without removing the guard.

Figure 4:
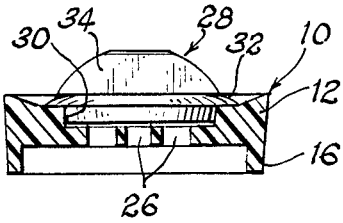
FIG. 4 is a section through the grid portion of the body of the guard showing the plug in place.
Figure 5:
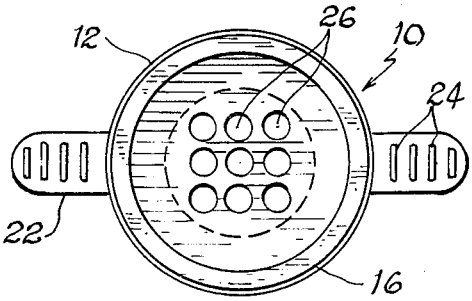
FIG. 5 is a bottom plan view of the first portion of the guard.

The second part of the apparatus is indicated at 28. This piece is a plug, and fits into the tapered cylindrical bore 30, making a snug, watertight fit so that when the plug is in place, the sink is completely stopped. This mode is shown in FIG. 4. The plug has a rubbery flange 32 around the edge, above its stopper portion, and a raised rib 34 to permit it to be easily gripped for removal and insertion.

Disposals are fairly standardized in their mouth diameters so that one model of the invention would fit almost all disposals, although obviously modified guards could be produced for varying sizes of disposal openings. The disposal guard is thus substantially universal in its application, is economical to produce, very simple to insert and remove, and provides a simple way of accommodating the three modes of use of sinks having disposals in them with a minimum of complexity.

I claim:

1. For a garbage disposal unit having a circular mouth through which garbage is introduced to be ground up and washed away through the waste line, a two piece disposal guard comprising:

(a) one of said pieces being a body portion having a substantially cylindrical external wall dimensioned to fit snugly but removably within said mouth;

(b) said body portion having a central apertured grid to pass water through said body portion but substantially block solid objects;

(c) the second piece of said two piece disposal guard being a plug to releasably cover said grid to selectably prevent the passage of water therethrough;

(d) gripper means comprising a pair of resilient, oppositely directed flexible tabs defining spaced frictional elements extending from said body portion and dimensioned to lie substantially flat over the surface of a sink in which said mouth is defined and engagable with a user's fingers to pull said body portion out of the mount of a garbage disposal; and, (e) said body portion having a top side and defining a cylindrical bore around and above said grid, and said plug being dimensioned to be frictionally pressed into said bore in water-tight relationship with said body and having a central rib which is finger-operable to make said plug easily removable, whereby with said body portions removed said mouth is completely open, when said body portion is in place said mouth is covered by a grid, and with said plug pressed into the bore in said body portion, said mouth is completely closed, so that use of the two pieces of said disposal guard effects all three modes of operation of the mouth of said garbage disposal.

* * * * *